United States Patent [19]

Buikus

[11] 3,930,389

[45] Jan. 6, 1976

[54] LOCK AND SUPPORT DEVICE FOR FUEL TANK

[76] Inventor: Robert Buikus, 1430 NE. 55th St., Fort Lauderdale, Fla. 33308

[22] Filed: Feb. 24, 1975

[21] Appl. No.: 552,259

[52] U.S. Cl. ..... 70/164; 70/58; 70/230; 137/383; 138/89; 220/210

[51] Int. Cl.[2] ..... B65D 55/14; E05B 73/00

[58] Field of Search ..... 70/58, 163, 164, 175, 177, 70/208, 209, 212, 229, 230; 137/383, 384 L, 385; 138/89, 89.1, 89.2, 89.3, 89.4; 220/85 P, 210, 214

[56] References Cited

UNITED STATES PATENTS

| | | | |
|---|---|---|---|
| 1,313,687 | 8/1919 | Hellweg | 224/42.4 |
| 2,077,997 | 4/1937 | Hedene | 137/384 |

FOREIGN PATENTS OR APPLICATIONS

| | | | |
|---|---|---|---|
| 542,273 | 1/1942 | United Kingdom | 70/164 |

*Primary Examiner*—Albert G. Craig, Jr.

[57] ABSTRACT

A lock and support device for fuel tanks holding acetylene gas and the like. The lock and support device includes an outlet cap, a locking bar, and an intermediate lock connecting ring that is connected between the outlet cap and the locking bar. The outlet cap screws over the outlet of the valve that is permanently attached to the top of the fuel tank in order to connect the lock and support device to the fuel tank and to cover the valve outlet. The locking bar may be used as a handle and as a means to prevent removing the outlet cap. The lock connecting ring is used as a means to support the tank in an upright position, and as a connection means for locking the tank to a fixed object.

6 Claims, 4 Drawing Figures

LOCK AND SUPPORT DEVICE FOR FUEL TANK

BACKGROUND OF THE INVENTION

This invention is for a new and improved lock and support device, and more particularly, to a lock and support device having a valve cap, a valve cap locking bar to secure the valve cap on a fuel tank, and a lock connecting portion or ring for providing a means to hold the fuel tank in an upright secured position and for providing a means to lock the tank to a fixed object.

In the past fuel tanks have been positioned in an upright position by standing them on their bases. Fuel tanks have been secured to fixed objects by wrapping chains around them or providing specially made tank racks. Fuel tanks are easily knocked over if left unsecured to a fixed object. Fuel tanks that are not held in an upright position are safety hazards.

BRIEF DESCRIPTION OF THE INVENTION

A new and improved lock and support device for fuel tanks that may be utilized as a handle to carry a fuel tank having a permanent valve fixed thereon, that caps the threaded valve outlet of the fuel tank, that provides a locking means to prevent removal of the outlet cap and that provides a lock connecting portion for locking the tank in an upright position to a fixed structure.

The lock and support device includes an outlet cap, a locking bar, and an intermediate lock connecting portion or ring connected between the outlet cap and the locking bar. The outlet cap screws over the outlet of the valve to connect the lock and support device to the fuel tank and to cover the outlet. The locking bar may be used as a handle as well as a means to prevent removing the outlet cap from the valve outlet. The lock connecting means supports the locking bar, supports the tank in an upright position, and is a means that is used to lock the tank to a fixed object. When the lock and support device is connected to the valve and the locking bar, pivotally connected to the connecting portion, is placed in a general horizontal position over the valve, a locking device may be threaded through the upper portion of the lock connecting portion in order to prevent removing the cap used to stop gases that may flow out of the valve outlet and to prevent removing the lock and support device from the fuel tank.

It is an object of this invention to provide a new and useful fuel tank lock and support device.

It is another object of this invention to provide a non-complex low-cost lock and support device for fuel tanks that caps the valve outlet.

It is another object of this invention to provide a lock and support device for easily fixing a fuel tank in an upright position.

It is another object of this invention to provide a lock and support device that provides a convenient carrying means for fuel tanks.

It is an additional object of this invention to provide a lock and support device that is easily locked to a fixed object.

In accordance with these and other objects which will be apparent hereinafter, the instant invention will now be described with particular reference to the accompanying drawing.

DESCRIPTION OF A PREFERRED EMBODIMENT

Figure 1:
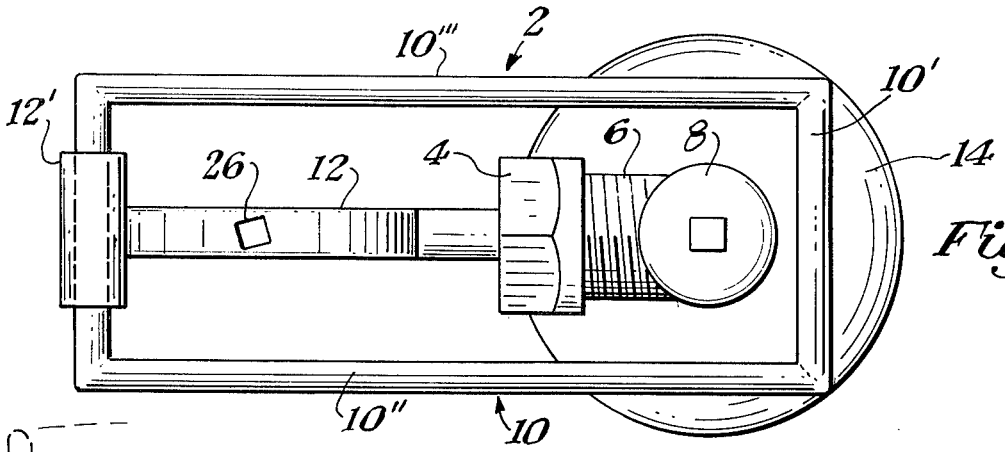
FIG. 1 is a top view of the lock and support device.

Referring now in detail to the drawing, wherein an embodiment of the invention is shown, the lock and support device is generally designated by numeral 2, includes an outlet cap or secureing means 4 having internal threads, for capping the outlet 6 of the fuel valve 8. The lock and support device 2 also includes a locking bar 10 that is shown as a generally rectangular ring that is sized to surround the fuel valve. The lock connecting means or lock connecting ring 12 is connected to and connected between the outlet cap 4 and the locking bar 10. The outlet cap 4 is fixed to the lock connecting ring 12. The locking bar 6 is rotatably connected in the extension 12' of the lock connecting ring 12.

Figure 2:
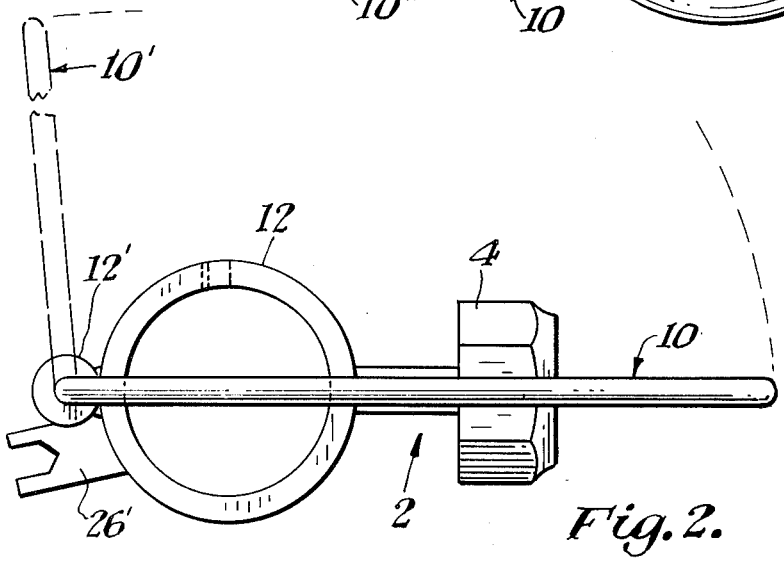
FIG. 2 is a side view of the lock and support device with the locking bar shown in phantom in a generally vertical position.
Figure 4:
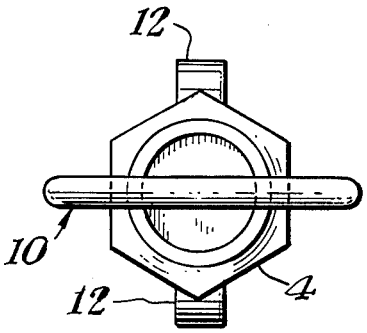
FIG. 4 is an end view of the lock and support device.
Figure 3:
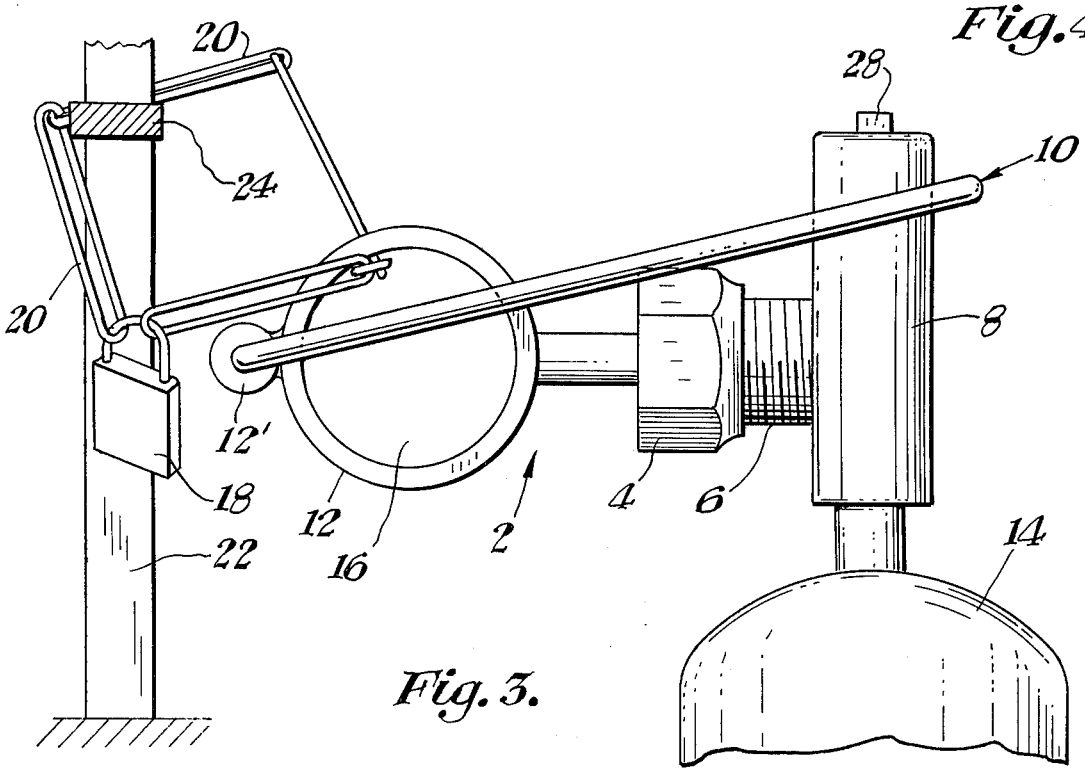
FIG. 3 is a side view of the lock and support device connected to a fuel tank and to a fixed structure.

As shown in FIGS. 2 and 3, the locking bar 10 may be placed in a generally horizontal position or may be rotated upwardly into a vertical position as shown in phantom by the dotted lines designated 10'. The locking bar 10 secures the lock and support device 2, on the outlet 6 of the fuel valve 8 when it is in a position as shown in FIG. 3. After the locking bar rotates over the valve 8, as shown in FIG. 3, the lock and support device 2 cannot be rotated in order to unscrew the outlet cap 4 from the fuel valve outlet 6 that has external threads. When the locking bar 6 is moved into a position as shown in phantom in FIG. 2 or into a position 180° from the position of the locking bar 6 in FIGS. 2 or 3, the lock and support device 2 may be rotated in order to remove the outlet cap 4 from the valve outlet 6.

The valve 8 is connected to tank 14 by a threaded connection. The valve is generally securely tightened on the tank. It normally takes a great force to remove the valve from the tank 14.

It should be noted that when the locking bar 6 is moved to a generally vertical position the distal portion of the locking bar 10' may be used as a handle to carry the fuel tank 14 and valve.

In order to lock the bar 10 over the valve 8 as shown in FIG. 3, a locking means such as a chain 20 or a padlock, not shown, may be attached to the opening shown by numeral 16. When the chain or lock is connected through opening 16, the lock shaft or the chain link will prevent movement of bar 10 from a position shown in FIG. 2 to the phantom position, shown in FIG. 2. The chain link is sized to prevent movement of the bar 10 to a position in which it will not engage the valve 8 or tank 14 when the lock and support device is rotated. FIG. 3 also shows that the chain 20 may pass around a fixed member 24 that is connected to a post 22 that is fixed in the ground, a floor, a truck bed or the like. Lock 18 is used to secure the two ends of the chain together around the member 24. It should be noted that bicycle locks may be used to secure the member 24 to the lock connecting ring opening 16.

In use, the outlet 6 is capped by first turning the locking bar 10 to a position as shown in phantom in FIG. 2, then the outlet cap 4 is threaded on the outlet 6 of valve 8. Thereafter the locking bar 10 may be passed over the valve 8. A locking means such as a lock or a chain is passed through opening 16 in the lock connecting ring 12 to secure the bar 10 in a locked position. To secure the tank in an upright position in relationship to a member fixed such as a truck bed, a floor or the ground, the lock or chain 20 is fixed to a member, such as member 24.

A keyway 26 may be cut into the locking ring to provide a means for turning the valve control shaft 28 off or on to release the gas stored in fuel tank 14. Also a wrench attachment 26' may be connected to the lock connecting ring for removing fittings from the tank valve outlet when the outlet is connected to welding or heating apparatus, not shown.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A lock and support device for a fuel tank means that includes a fuel tank with a generally fixed valve having an outlet comprising:

a capping and securing means connectable to the outlet, a lock connecting means attached to said capping and securing means, a moveable bar connected to said lock connecting means for movement between a first position engaging the fuel tank means to lock said capping and securing means on the outlet and a second position allowing movement of said capping and securing means to disengage said lock and support device from the outlet, said lock connecting means includes a securing portion that may be utilized to secure said bar in said first position.

2. A lock and support device as set forth in claim 1 wherein;

said capping and securing means is rotatably connected to the valve outlet.

3. A lock and support device as set forth in claim 2 wherein;

said bar is ring-shaped for movement over the valve to prevent removal of said capping and securing means.

4. A lock and support device as set forth in claim 3 including;

a connecting means attachable to said securing portion to prevent movement of the moveable bar from the first position, said connecting means attachable to a fixed object to hold said tank in an upright position and to prevent theft.

5. A lock and support device as set forth in claim 4 wherein;

said bar is a handle when placed in a generally vertical position.

6. A lock and support device as set forth in claim 5 including;

a valve keyway in said lock connecting means and a wrench connected to said lock connecting means.

* * * * *